United States Patent [19]

Breslow

[11] 4,413,823

[45] Nov. 8, 1983

[54] BALL PUZZLE

[75] Inventor: Jeffrey D. Breslow, Highland Park, Ill.

[73] Assignee: Marvin Glass & Associates, Chicago, Ill.

[21] Appl. No.: 203,331

[22] Filed: Nov. 3, 1980

[51] Int. Cl.[3] ..... A63F 9/08

[52] U.S. Cl. ..... 273/153 S; 273/113

[58] Field of Search ..... 273/153 S, 111, 113, 273/115; 434/174

[56] References Cited

U.S. PATENT DOCUMENTS

| | | | |
|---|---|---|---|
| 600,696 | 3/1898 | Patterson | 273/113 |
| 3,235,976 | 2/1966 | Elliott et al. | 273/299 X |
| 3,239,951 | 3/1966 | Benson | 273/153 S X |
| 3,610,628 | 10/1971 | Promin | 273/138 R |
| 3,895,808 | 7/1975 | Averette | 273/138 R |
| 4,208,052 | 6/1980 | Snow | 273/153 S X |

FOREIGN PATENT DOCUMENTS

| | | | |
|---|---|---|---|
| 2434523 | 8/1975 | Fed. Rep. of Germany | 273/115 |

*Primary Examiner*—Anton O. Oechsle
*Attorney, Agent, or Firm*—McDermott, Will & Emery

[57] ABSTRACT

A ball puzzle includes a pair of base members rotatably joined to one another and a predetermined number of apertures defined in each member. The apertures are aligned such that only one aperture in each member may be aligned at a single time. The puzzle also includes a plurality of closed-end container members extending axially from each aperture with a container member in communication with each aperture. A plurality of playing objects are provided sufficient in number to fill all of the container members except one. The playing objects are of a size and shape to allow them to pass through aligned apertures between containers on opposite sides of the base members. The playing objects are divided into distinguishable groups, for example each group being identical in configuration, color or indicia thereon. The color, configuration or indicia of each playing object in each group is different from that of the playing objects in the other groups.

14 Claims, 5 Drawing Figures

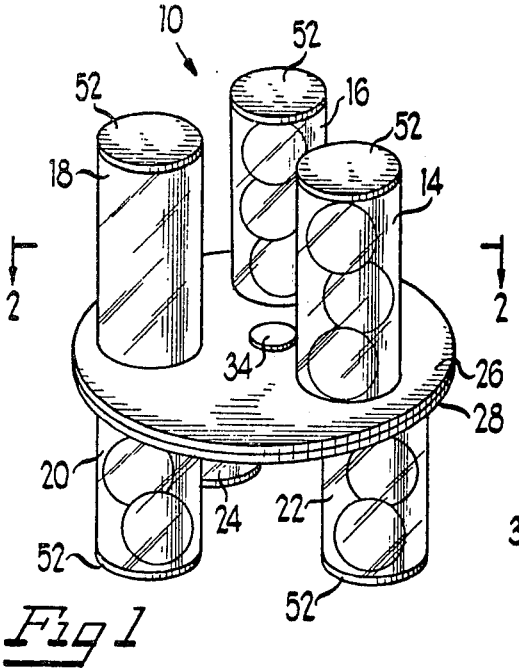
Fig 1
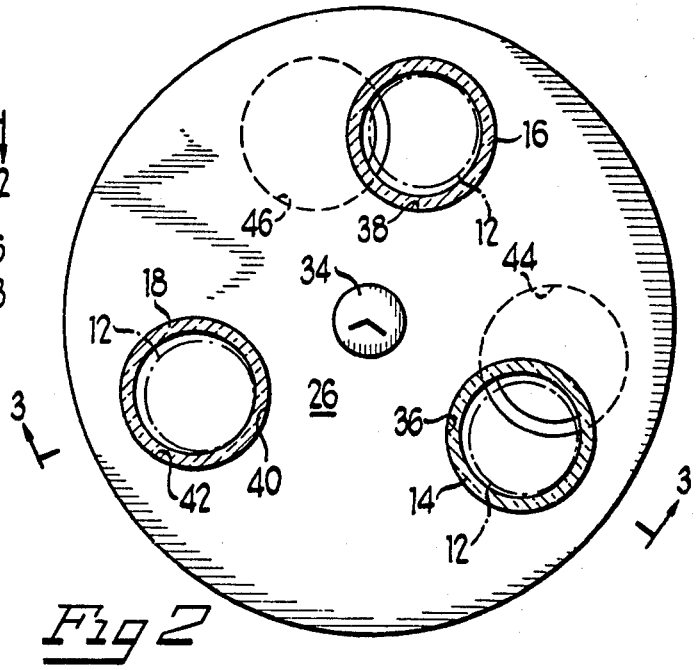
Fig 2
Fig 3
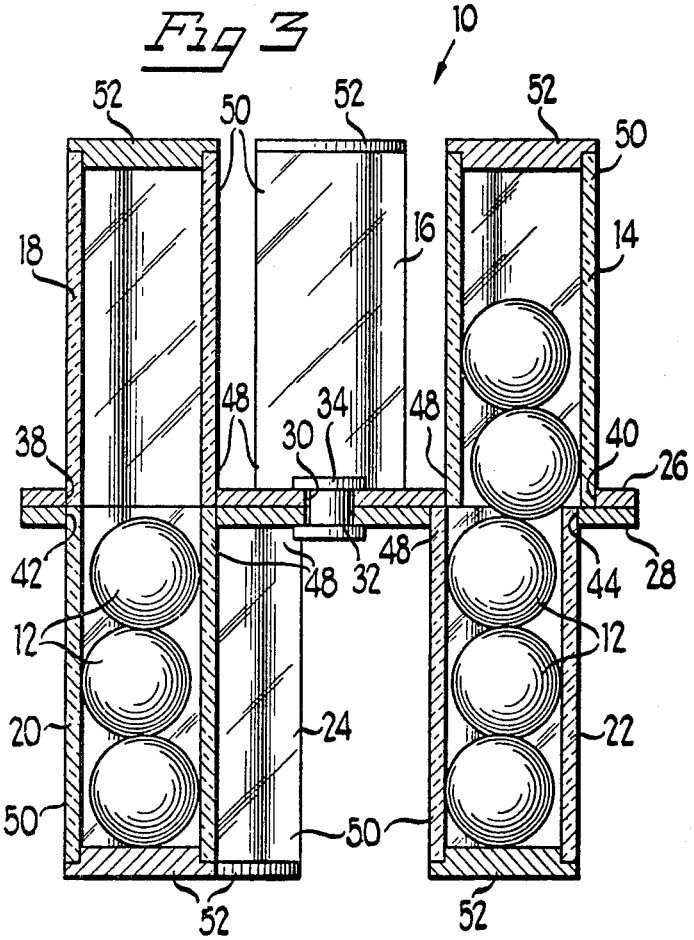
Fig 4
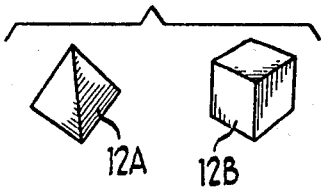
Fig 5
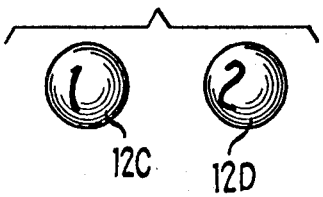

BALL PUZZLE

BACKGROUND OF THE INVENTION

A. Field of the Invention

The present invention relates to a new improved ball puzzle that is intellectually challenging and entertaining.

B. Description of the Prior Art

One of the oldest forms of entertainment for both children and adults have been puzzles. Some such appealing puzzles are crossword puzzles and jigsaw puzzles. One particular type of puzzle that is not only entertaining, but also provides an intellectual challenge as well as requiring hand and eye coordination is of the type that includes a planar support member with a peripheral ridge or rim defining a surface upon which are placed a predetermined number of squares. The squares are slideably connected by a tongue and groove defined on the peripheral surface of each square. Each square includes a different indicia such as the letters of the alphabet and all of the squares cover the entire surface except for one space the size of a single square. The object of this prior art puzzle is to position different sequences of letters by moving the location of the open space around the playing surface by manipulation and sliding of the different squares.

The initial manipulation of the squares of the prior art puzzle wherein the first letters are aligned in a predetermined sequence is relatively easy; however, as more of the squares are aligned in the preferred sequence, less room is available for manipulation of the remaining squares. Thus, the challenge becomes increasingly greater as the end of the puzzle nears. Such a prior puzzle requires eye hand coordination in moving the squares and intellectual concentration as the number of alternatives and moving of the squares. Successful completion of the prior art puzzle requires advance planning of several moves before the actual physical moving of the squares.

Such a prior art puzzle is challenging not only to children but also to adults and can provide many hours of entertainment while being intellectually stimulating.

SUMMARY OF THE INVENTION

An object of the present invention is to provide a new and improved puzzle that is increasingly challenging as the playing of the puzzle continues.

A further object of the present invention is to provide a new and improved puzzle that may be easily carried by either a child or an adult and may be played for a period of time, stored and playing with the puzzle continued from the point stopped when stored without any disruption in the game.

The present invention is directed to a new and improved puzzle the object of which is to place objects of the same color, configuration or indicia in a single container. The puzzle includes a plurality of containers each of which, except one, is intended to include, at the completion of the puzzle, only objects of the same color, configuration or indicia.

Specifically, the puzzle of the present invention includes a pair of base members rotatably secured together. Each of the base members includes a predetermined number of apertures in locations such that only one aperture in each base member may be aligned at a single time. An equal number of container members are secured to the base members in communication with a single aperture.

The puzzle also includes a plurality of playing objects that are divided into groups equal in number to the number of containers less one. Each group of playing objects is of an identical configuration, color or indicia. It is the object of the game by manipulation of the apertures to place a single group of objects in a single container.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 1 is a perspective view of a puzzle constructed in accordance with the principles of the present invention;

FIG. 2 is an enlarged view taken along line 2—2 of FIG. 1;

FIG. 3 is a view taken along line 3—3 of FIG. 2;

FIG. 4 is a view of alternative playing objects of different possible configurations; and FIG. 5 is a view of alternative playing objects bearing different possible indicia.

DESCRIPTION OF THE PREFERRED EMBODIMENT

With reference now to the drawings there is illustrated a puzzle generally designated by the reference numeral 10 and constructed in accordance with the principles of the present invention. The puzzle 10 is intended to be intellectually challenging requiring exercise of hand and eye coordination and motor skills and is challenging and entertaining to both adults and children.

The object of the puzzle 10 or solution is to position all of the playing objects 12 of a distinguishable group in one of the closed-end container members 14–24. The playing objects 12 of each group are identical in configuration (FIG. 4), color (FIGS. 1 and 3) or indicia thereon (FIG. 5); however, one skilled in the art will recognize that other features that would make groups of playing objects 12 identical ar also available. As will be understood, the puzzle 10 is intellectually challenging. As more of the container members 14–24 are filled, there are fewer container members 14–24 in which to maneuver the remaining playing objects 12; thus, increasing the complexity of the puzzle and requiring the user of the puzzle to exercise careful thought and consideration and preplanning of movements in order to complete the puzzle.

The particular structure of the puzzle 10 is best illustrated in the drawings. Turning first to FIGS. 1 and 3, the puzzle 10 is illustrated as including a first or top base member 26 and a second or bottom 28 base or plate member that may be fabricated from plastic sheet material. In the preferred embodiment, the plate members 26 and 28 are illustrated as of a circular configuration; however, any configuration such as square or rectangular may also be used. The top plate member 26 includes a central aperture 30 that is aligned with a similar aperture 32 in the bottom plate member 28. Connecting means such as a plastic rivet or screw 34 if positioned in the aligned apertures 30 and 32 so as to secure the plate members 26 and 28 together to maintain the plate members 26 and 28 in close relationship while allowing rotation relative to each other.

Within the top plate member 26 and radially outward from the central aperture 30 are defined predetermined apertures 36, 38 and 40. In the preferred embodiment illustrated, there are three apertures 36–40; however, the number of apertures may be varied in accordance with the preference of the manufacturer. Similarly, in the preferred embodiment illustrated, three apertures 42, 44 and 46 are also defined in the bottom plate member 28.

In accordance with the principles of the present invention, containers 14–24 in the preferred embodiment are clear plastic cylinders. It should be understood, however, that the configuration of the containers 14–24 may vary in accordance with the configuration of the playing objects 12. The cylinders 14–24 are open at two ends. The first end 48 of each of the containers 14–24 is secured in a corresponding aperture 36–46 respectively. A second end 50 of each cylinder 14–24 is closed by a cap member 52 thus defining, in the preferred embodiment, a cylinder of sufficient dimension to allow placement therein of one or more of the playing objects 12.

The apertures 36–46 are defined at locations in the first 26 and second 28 plate members such that at a single time only one aperture in the first plate member 26 may be aligned with one aperture in the second plate member 28. As best illustrated in FIG. 2, apertures 40 and 42 are aligned whereas apertures 36 and 44 and apertures 38 and 46 are slightly out of alignment such that the playing objects 12 may pass between the container members 18 and 20 but may not pass between the container members 16 and 24 or 14 and 22.

With particular reference to FIGS. 1 and 3, it is noted that, in the preferred embodiment illustrated, there are 15 playing objects 12. Each container member 14–24 can hold up to three playing objects. As illustrated in FIG. 1, container members 14, 16, 20, 22 and 24 each include three playing objects 12 for a total of fifteen playing objects, whereas container 18 is empty.

In accordance with the principles of the puzzle 10, the fifteen playing objects 12 are divided into five groups of three each. Each group, in the preferred embodiment illustrated, is of a single color. For example, the playing objects 12 in container 14 may be all red, whereas the playing objects in the container 16 may be all blue, the playing objects in the container 20 may be all green, the playing objects 12 in the container 22 may be all yellow, and the playing objects 12 in the container 24 may be all black. As illustrated in FIG. 4, in an alternative embodiment, each group of playing objects 12 may be of a different configuration such as triangular or pyramid shape 12A or a square shape 12B and in accordance with the principles of the present invention there would be three other differently configured groups of playing objects. Also, another alternative would be to have each group of playing objects include different indicia such as in FIG. 5 where the playing object 12C includes the indicia 1 and the playing object 12D bears the indicia 2. Again, in accordance with the principles of the present invention, there would be three other groups of playing objects each including the same indicia such as indicies 3, 4 and 5.

In accordance with the solution of the puzzle 10, there may be many variations of playing the puzzle. For example, it may be desired to position three playing objects 12 of different colors, different shapes or different indicia in a single container member 14–24. Another object to the puzzle 10 could be to place playing objects 12 of the same group such as the same configuration, color or indicia in each container member 14–24. Another variation would be to place two playing objects of the same group with one playing object of a different group in the same container 14–24. For example, in the preferred embodiment, each container 14–18 would include one black playing object and two other objects 12 from the same group.

To accomplish any of the above-mentioned objectives, the player of the puzzle 10 must rotate different containers members 14–24 into alignment with other container members and pass one or more playing objects 12 from one container member to another. By rotating and aligning different container members and passing different numbers of playing objects 12 therebetween, the desired objectives can be accomplished; however, such a procedure requires substantial intellectual concentration as more of the container members 14–24 are filled with the desired combination of playing objects 12.

The puzzle 10, in the preferred embodiment, is made of plastic that may be clear or colored and the playing objects 12 may be marbles or plastic spheres. In addition, the size of the puzzle 10 and the durability of the plastic from which it is made is preselected to allow it to be carried with the player and be used at home, in an automobile or similar vehicle. As can be understood, the playing of the puzzle 10 may be interrupted for a period of time and continued later without changing the position of the playing objects between playing times thereby allowing continued playing without requiring the player to restart the puzzle 10.

It will be understood by one skilled in the art that the configuration and number of the container members 14–24 and the number of playing objects 12 may be varied in accordance with the desires of one skilled in the art in order to increase the challenge posed by the puzzle and to vary the motor skills required by the operator and the user of the puzzle 10.

What is claimed is:

1. A puzzle comprising:

first and second base members rotatable coaxially relative to each other;

an equal number of apertures in said first and second base members;

an equal number of container means secured to said first and second base members, each said container means being in communication with one of said apertures;

a predetermined number of playing objects positionable in said container means, said objects being divided into a plurality of said objects, whereby a player can solve the puzzle by moving the objects to position each group in one of the container means; and said apertures being defined in said first and second base members such that only one aperture in said first base member may be aligned with one aperture in said second base member at a time to allow one or more of said objects to move from one container means to another.

2. The puzzle claimed in claim 1 wherein said objects are divided into groups and the objects in the same group are identical in color and are different in color from the objects of the other groups.

3. The puzzle claimed in claim 1 wherein said objects are divided into groups and each object in the same group has identical indicia that is different indicia than those on said objects in the other groups.

4. The puzzle claimed in claims 2 or 3 where the number of said groups is equal to the number of container means less one.

5. A puzzle comprising:

a pair of opposed plate members rotatably and coaxially mounted together;

a plurality of apertures defined in said plate members;

a plurality of containers secured to said plate members, each said container being in communication with one of said apertures wherein said apertures are defined in said plate members such that at one time only a single aperture in one of said plate members may be in complete alignment with a single aperture in the other plate member; and a plurality of playing objects divided into distinguishable groups equal in number to the number of containers less one and slideably captured in said container.

6. The puzzle claimed in claim 5 wherein the number of apertures defined in either plate member is equal to the number of apertures defined in the other plate member.

7. The puzzle claimed in claim 5 wherein the number of said containers equals the number of said apertures.

8. The puzzle claimed in claim 5 wherein said objects in the same group are of the same color.

9. The puzzle claimed in claim 5 wherein said objects in the same group are of the same configuration.

10. The puzzle claimed in claim 5 wherein said objects in the same group bear the same indicia.

11. A puzzle comprising:

a first and second coaxial relatively rotatable container means secured in opposition to one another, each of said container means including a plurality of compartments;

a transferring means between said first and second container means for allowing said compartments of said first container means to communicate only one at a time with said compartments of said second container means; and a predetermined number of playing objects positionable in each of said container means, said objects being divided into a plurality of distinguishable groups, said objects movable from one compartment to another through said transferring means.

12. The puzzle of claim 11 wherein said transferring means includes a pair of opposed plate members, each of said members mounted on one of said container means for rotation relative to the other of said members.

13. The puzzle of claim 12 wherein each of said plate members includes a plurality of apertures defined in said plate members, said apertures arranged such that at one time only a single aperture in one of said plate members may be in complete alignment with a single aperture in the other plate member.

14. The puzzle of claim 13 wherein each of said compartments extends generally perpendicularly away from one of said plate members.

* * * * *